US011591753B2

(12) United States Patent
Bohn Stoltz et al.

(10) Patent No.: US 11,591,753 B2
(45) Date of Patent: Feb. 28, 2023

(54) METHOD OF PRODUCING HYDROPHOBIC PAPER

(71) Applicant: SCA Forest Products AB, Sundsvall (SE)

(72) Inventors: Raquel Bohn Stoltz, Stockholm (SE); Birgitta Lindberg, Stöde (SE)

(73) Assignee: SCA FOREST PRODUCTS AB, Sundsvall (SE)

( * ) Notice: Subject to any disclaimer, the term of this patent is extended or adjusted under 35 U.S.C. 154(b) by 17 days.

(21) Appl. No.: 17/047,447

(22) PCT Filed: Apr. 25, 2019

(86) PCT No.: PCT/EP2019/060621
§ 371 (c)(1),
(2) Date: Oct. 14, 2020

(87) PCT Pub. No.: WO2019/207048
PCT Pub. Date: Oct. 31, 2019

(65) Prior Publication Data

US 2021/0148052 A1 May 20, 2021

(30) Foreign Application Priority Data

Apr. 26, 2018 (EP) ..... 18169555

(51) Int. Cl.

| | |
|---|---|
| ***D21H 21/16*** | (2006.01) |
| ***D21H 11/04*** | (2006.01) |
| ***D21H 17/06*** | (2006.01) |
| ***D21H 17/15*** | (2006.01) |
| ***D21H 17/22*** | (2006.01) |
| ***D21H 17/23*** | (2006.01) |
| ***D21H 17/29*** | (2006.01) |
| ***D21H 17/62*** | (2006.01) |
| ***D21H 17/66*** | (2006.01) |
| ***D21H 23/04*** | (2006.01) |

(52) U.S. Cl.
CPC ..... *D21H 21/16* (2013.01); *D21H 11/04* (2013.01); *D21H 17/06* (2013.01); *D21H 17/15* (2013.01); *D21H 17/22* (2013.01); *D21H 17/23* (2013.01); *D21H 17/29* (2013.01); *D21H 17/62* (2013.01); *D21H 17/66* (2013.01); *D21H 23/04* (2013.01)

(58) Field of Classification Search
CPC ..... D21H 11/04; D21H 21/16; D21H 17/66; D21H 21/10; D21H 17/23; D21H 17/22; D21H 17/28; D21H 17/29; D21H 17/06; D21H 17/62; D21H 23/04; D21H 17/15
USPC ..... 162/174
See application file for complete search history.

(56) References Cited

U.S. PATENT DOCUMENTS

| | | | | |
|---|---|---|---|---|
| 5,846,788 | A | 12/1998 | Pedersen et al. | |
| 6,494,991 | B1 | 12/2002 | Palmer et al. | |
| 2003/0127204 | A1 | 7/2003 | Varnell | |
| 2012/0047794 | A1 | 3/2012 | Bartek et al. | |
| 2017/0335520 | A1* | 11/2017 | Ehrhardt | D21H 17/23 |
| 2019/0382959 | A1* | 12/2019 | Bergmark | D21H 17/29 |

FOREIGN PATENT DOCUMENTS

| | | | |
|---|---|---|---|
| CN | 1782227 | A | 6/2006 |
| EP | 1 088 856 | A1 | 4/2001 |
| GB | 237 292 | A | 8/1926 |
| RU | 2243306 | C2 | 12/2004 |
| RU | 2245408 | C2 | 1/2005 |
| RU | 2293090 | C2 | 2/2007 |
| SU | 118698 | A1 | 11/1958 |
| WO | WO-02/33172 | A1 | 4/2002 |
| WO | WO-2006/002867 | A1 | 1/2006 |
| WO | WO-2006/119357 | A2 | 11/2006 |
| WO | WO-2006/119357 | A3 | 1/2007 |
| WO | WO-2007/141197 | A1 | 12/2007 |
| WO | WO-2012/047314 | A1 | 4/2012 |
| WO | WO-2014/138100 | A1 | 9/2014 |
| WO | WO-2017/048163 | A1 | 3/2017 |
| WO | WO-2017/048164 | A1 | 3/2017 |
| WO | WO-2017/192281 | A1 | 11/2017 |
| WO | WO-2018/169459 | A1 | 9/2018 |

OTHER PUBLICATIONS

Palmer, et al., Certificate of Correction issued in U.S. Pat. No. 6,494,991B1 dated Dec. 17, 2002, 2 pages.
Search Report issued in Russian patent application No. 2020133483, dated Feb. 10, 2022 (with English translation).
Extended European search report from European patent application No. 18169555.2, dated Jul. 23, 2018.
Abdelaziz, Omar Y., et al. "Biological calorization of low molecular weight lignin," Biotechnology Advances 34, 2016, pp. 1318-1346.
Allan, G. G., et al., Fiber Surface Modification. Part IX Removal of Phenolic Pollutants from Water by Oxidative Coupling to Lignocellulosic Substrates, Papper och Trä No. 6 (1971).
Allan, G. G., et al., Fiber Surface Modification Part VIII. The Grafting of Phenolic Compounds Onto Lignocellulosic Fibers by Oxidative Coupling, Tappi, vol. 54, No. 2., Feb. 1971.
Allan, G. G., et al., Fiber surface modification Part 19. The attachment of lignin model compounds to lignocellulosic fibers using cyanuric chloride, svensk papperstidning, No. 18, 1976.
Buono, Pietro, et al., New Insights on the Chemical Modification of Lignin: Acetylation versus Silylation, ACS Sustainable Chemistry & Engineering 2016, 4, pp. 5212-5222.

(Continued)

*Primary Examiner* — Mark Halpern
(74) *Attorney, Agent, or Firm* — Faegre Drinker Biddle & Reath LLP

(57) ABSTRACT

The present disclosure relates to a method of producing hydrophobic paper, using a sizing additive based on depolymerized lignin and a hydrophobic paper obtainable by such method.

16 Claims, 5 Drawing Sheets

(56) References Cited

OTHER PUBLICATIONS

Gärtner, Anna et al., "Determination of phenolic hydroxyl groups in residual lignin using a modified UV-method," Nordic Pulp and Paper Research Journal 1999, vol. 14, No. 2, pp. 163-170.
Guvenatam, B. et al., "Catalytic pathways for lignin depolymerization," Ph.D. Thesis from Eindhoven Technische Universiteit, (2015).
Helander, Mikaela, et al., "Fractionating of Technical Lignin: Molecular Mass and pH Effects," BioResources 2013, 8(2), pp. 2270-2282.
Huang, Xiaoming, et al, "Ethanol as Capping Agent and Formaldehyde Scavenger for Efficient Depolymerization of Lignin to Aromatics," Green Chem., 2015.
Hubbe, M.A., "Acidic and Alkaline Sizings for Printing, Writing, and Drawing Papers," The Book and Paper Group Annual 23, 2004, pp. 139-151.
Katahira, Rui, et al., "Base-Catalyzed Depolymerization of Biorefinery Lignins," ACS Sustainable Chem. Eng. 2016, vol. 4, pp. 1474-1486.
Lugemwa, Fulgentius Nelson, et al., "Facile and Efficient Acetylation of Primary Alcohols and Phenols with Acetic Anhydride Catalyzed by Dried Sodium Bicarbonate," Catalysts 2013, vol. 3, pp. 954-965.
Antonsson, Stefan, "The us of lignin derivatives to improve selected paper properties," Ph.D. Thesis from Royal Institute of Technolgy Department of Fibre and Polymer Technology Division of Wood Chemistry and Pulp Technology, Stockholm 2007.
Zhu, Weizhen, "Precipitation of Kraft Lignin," Ph.D. Thesis for the Degree of Doctor of Philosophy from Forest Products and Chemical Engineering, Department of Chemistry and Chemical Engineering, Chalmers University of Technology, Gothenburg, Sweden, 2015.

* cited by examiner

METHOD OF PRODUCING HYDROPHOBIC PAPER

CROSS-REFERENCE TO PRIOR APPLICATIONS

This application is a § 371 National Stage Application of PCT International Application No. PCT/EP2019/060621 filed Apr. 25, 2019, which claims priority to European Patent Application No. 18169555.2 filed on Apr. 26, 2018, both of which are incorporated herein in their entirety.

TECHNICAL FIELD

The present disclosure relates to a method of producing hydrophobic paper, using a sizing additive comprising a blend of a depolymerized lignin having an average molecular weight of 400-2500 g/mol with an auxiliary component selected from a cationic polysaccharide and/or gelatin and a hydrophobic paper obtainable by such method.

BACKGROUND ART

Sizing agents, such as alkenyl succinic anhydride (ASA) or alkyl ketene dimer (AKD), are commonly used in the paper making industry as components in sizing dispersion formulations, for obtaining paper products with reduced tendency when dry to absorb liquid, and for improving printing properties. WO0233172A1 describes a sizing dispersant system comprising sodium lignosulfonate, which can be used to obtain water-repellant properties in the paper.

PCT/SE 2017/050250 relates to a method of preparing a sizing boost additive comprising a lignin oil/polysaccharide blend wherein the lignin oil is obtained by base catalyzed depolymerization of lignin. The sizing boost additive can be used for the production of hydrophobic paper together with a hydrophobization agent such as ASA or AKD.

The use of hydrophobization agents such as ASA or AKD, however, leads to a substantial increase of costs in the paper manufacturing process. Further, papers manufactured with hydrophobization sizing agents are subject to size reversion resulting in an undesired increase in water-absorption after prolonged UV light exposure.

WO2017/192281 A1 relates to a composition and method for imparting paper and paperboard with resistance to aqueous penetrants using a sizing additive comprising a renewable biopolymer in combination with a water-soluble, hydroxylated polymer, e.g. starch. The renewable biopolymer is an alkaline solution or dispersion of crude or purified lignin. WO2017/192281 does not disclose a sizing additive comprising depolymerized lignin.

Thus, it is an object of the present invention to provide a novel sizing additive which can contribute to eliminate the use of traditional hydrophobization agents such as ASA, AKD and/or rosin in the manufacture of hydrophobic paper products, and to improve properties in such paper products.

SUMMARY OF THE INVENTION

A first aspect of the present invention is a method of producing hydrophobic paper comprising the step of adding (i) a sizing additive comprising a blend of a depolymerized lignin having an average molecular weight of 400-2500 g/mol with an auxiliary component selected from a cationic polysaccharide and/or gelatin, (ii) an aluminum salt, and (iii) optionally a retention aid, to a lignocellulosic pulp suspension at the wet end of a paper manufacturing process, wherein the depolymerized lignin is added in an amount of 0.5 to 20 kg/t dry pulp calculated as dry weight of depolymerized lignin, and the aluminum salt is added in an amount corresponding to at least 0.01 kg Al/t dry pulp.

A further aspect of the present invention is a hydrophobic paper obtainable by the method as described above.

Still a further aspect of the present invention is the use of a blend of a depolymerized lignin having an average molecular weight of 400-2500 g/mol, particularly of 400-1500 g/mol, 400-1300 g/mol, 400-1000 g/mol, or 500-800 g/mol with an auxiliary component particularly selected from a a cationic polysaccharide and/or gelatin, as the only sizing additive in the production of hydrophobic paper.

By means of the present invention the use of a hydrophobization agent such as ASA; AKD and/or rosin may be reduced or even obviated. Surprisingly, hydrophobic paper produced by using a sizing additive which is a blend of a depolymerized lignin having an average molecular weight of 400-2500 g/mol with an auxiliary component particularly selected from a cationic polysaccharide and/or gelatin, as the only sizing additive exhibits excellent properties, in particular an excellent UV stability.

DETAILED DESCRIPTION

Figure 1:
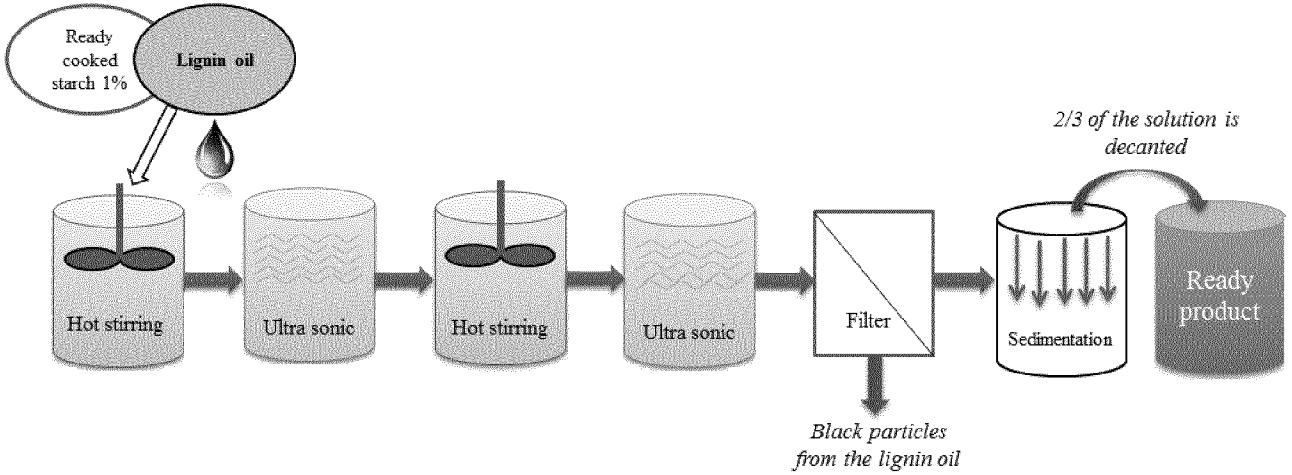
FIG. 1 shows schematically a process for blending depolymerized lignin with starch to produce a sizing additive for use in paper sheet production.

In the production of paper products, it is generally desirable to decrease the consumption of chemicals, both for environmental and for economic reasons. The present disclosure describes a method, which uses a depolymerized lignin, e.g., obtained by base-catalyzed depolymerization of lignin, as one of the starting materials.

The present inventors have found that a blend of a depolymerized lignin having an average molecular weight of 400-2500 g/mol with an auxiliary component, particularly selected from a cationic polysaccharide and/or gelatin is an excellent internal sizing additive for the manufacture of hydrophobic paper, in particular when used in combination with increased amounts of an aluminum salt as described herein. The depolymerized lignin can replace other sizing additives and improve the hydrophobic properties and UV stability of paper products.

The term "hydrophobic paper" is used herein and relates to paper which has been subjected to internal sizing during its manufacture. It is characterized by a Cobb 60 value of less or equal than 55 g/m$^2$ as determined according to ISO 535.

According to the present invention a hydrophobic paper is manufactured by adding a sizing additive at the wet end of a paper manufacturing process. The sizing additive is based on depolymerized lignin, i.e. it comprises a blend of depolymerized lignin having an average molecular weight of 400-2500 g/mol with an auxiliary component, particularly selected from a cationic polysaccharide and/or gelatin. The inventors found that the use of depolymerized lignin in the paper manufacturing process leads to a homogenous distribution of the depolymerized lignin in the paper pulp suspension thereby improving the sizing efficacy.

The weight ratio of depolymerized lignin and polysaccharide in the blend is e.g. about 1:0.1-10, preferably about 1:0.5-2 and more, preferably 1:0.9-1:1, wherein the weight of depolymerized lignin is the dry weight of depolymerized lignin and wherein the weight of the polysaccharide is the dry weight of polysaccharide.

The depolymerized lignin may be selected from any type of suitable depolymerized lignin, e.g. depolymerized kraft lignin, depolymerized lignin precipitated from kraft liquor, e.g. precipitated with carbon dioxide, such as LignoBoost™, depolymerized lignosulfonate lignin, depolymerized hydrolysis lignin, depolymerized organosolv lignin, depolymerized sulfur-free lignin, depolymerized lignin from fractionation under conditions which stabilize the structural integrity of the carbohydrates and lignin (lignin first biomass fractionation), e.g. fractionation with tandem depolymerization-stabilization or active preservation of β-O-4 bonds. The lignin may be depolymerized by known procedures such as base catalysis; acid catalysis; pyrolysis including fast pyrolysis; hydrothermal liquefaction; treatment with subcritical or supercritical fluids such as water, acetone, dioxane, $CO_2$, methanol, ethanol or combinations thereof;

treatment with a catalyst under reducing conditions, e.g. in the presence of $H_2$.

The depolymerized lignin is low molecular weight lignin. For example the depolymerized lignin is characterized by an average weight molecular weight of 400-2500 g/mol, 400-1500 g/mol, 400-1300 g/mol, 400-1000 g/mol, or 500-800 g/mol. In certain embodiments the depolymerized lignin is characterized by an average weight molecular weight of 400-1000 g/mol or 500-800 g/mol.

Moreover, the functional groups in lignin, mainly methoxy, carbonyl and phenolic hydroxyl groups, have a significant effect on the molecule reactivity. Depolymerization also improves the compatibility of the lignin with the non-polar polymer matrix by decreasing aliphatic hydroxyl content and improving the hydrophobicity (i.e. maintaining the amphiphilic behavior).

The lignin source used for obtaining the depolymerized lignin is preferably kraft black liquor. The patent applications PCT/SE2015/050970, PCT/SE2015/050969 and PCT/SE2017/050250 describe preferred methods, by means of which the depolymerized lignin can be obtained. The contents of these documents are herein incorporated by reference.

Depolymerized lignin obtainable using any of these processes may contain no more than 1-3 wt-% ash. It may have a sodium content of 1-50 ppm, and/or a potassium content of 1-30 ppm, a sulfur content of 1-3 wt-%, for example 2-3 wt-%. The final depolymerized lignin after the washing stage may have a low salt content, typically less than 50 ppm, which allows further processing thereof. The viscosity of the lignin oil at a shear rate of 500 s$^{-1}$ and at 25° C. may be in the range of 1000-3000 mPa s, especially in the range of 1600-2100 mPa s. Elemental analysis typically gives the following result:

| Element | Mass (%) |
|---|---|
| C | 60-70 |
| H | 5-7 |
| O | 20-30 |
| S | 1-3 |
| N | 0.1-0.3 |

The depolymerized lignin used as a sizing additive may be obtained by base-catalyzed depolymerization of kraft black liquor, suitably by means of a method comprising the steps of a) preparing a black liquor composition comprising kraft black liquor, and having a hydroxide ion concentration of 1-40 g/l based on the volume of black liquor, if necessary adjusting the hydroxide ion concentration by means of an addition of an acidifying agent (AA1);
b) reacting the black liquor composition in a reactor (R) and reacting the black liquor composition at 180-240° C. for 10-120 minutes in the absence or in the presence of a solid catalyst, thereby causing depolymerization of lignin in the black liquor;
c) cooling the composition to a temperature below the boiling point of a solvent to be added in a subsequent step;
d) acidifying the composition by adding one or more acidifying agents (AA2) until a pH of 4-5 is reached;
e) adding a solvent (S) to the composition, in order to extract oil phase from the composition;
f) separating the composition by phase separation in a first separation step (S1) into
   an oil phase (A) comprising solvent, oil, and organic acids,
   a first water phase (B) comprising water, salts, and non-depolymerized lignin solids,
   a second water phase (C1) comprising water and salts;
g) filtering (F2) the first phase (A) to remove any particles;
h) desalting the filtered oil phase (A) by
   washing it by adding water and separating by phase separation in a second separation step (S2) into
   an oil phase (D) comprising oil and solvent,
   a third water phase (C2) comprising salts; or
   adding adsorbent and/or absorbent material or ion exchange material, or combinations thereof; and i) evaporating (E2) the solvent comprised in the oil phase (D), thus obtaining the depolymerized lignin.

The sizing additive based on depolymerized lignin comprises the depolymerized lignin blend with an auxiliary component, e.g. a polysaccharide such as a cationic polysaccharide, and/or gelatin.

The cationic polysaccharide may be a gelatinized cationic polysaccharide which is obtainable as a solution by heating a dry cationic polysaccharide in a suitable liquid until gelatinization is reached. For example, a solution of a gelatinized cationic polysaccharide may be prepared by cooking dry cationic polysaccharide in water until completely gelatinized. The term "dry polysaccharide" refers in this context a polysaccharide in powder form having a moisture content in equilibrium with ambient moisture. The cationic polysaccharide can be for example starch, dextrin, amylose or chitosan. Starch is preferred since it is well known as strength additive, which is easily available, typically at a reasonable cost. When completely gelatinized, the concentration may suitably be adjusted to 0.5-23 wt-%, preferably 0.5-3 wt-%, based on the dry weight of added polysaccharide.

The depolymerized lignin and an aqueous solution of a gelatinized cationic polysaccharide, and optionally water are combined to obtain a blend of depolymerized lignin and polysaccharide, wherein according to step I) the cationic polysaccharide is subjected to heating in water until gelatinized; and wherein the depolymerized lignin and the cationic polysaccharide are included in the blend so that a weight ratio of depolymerized lignin to polysaccharide in the blend is usually 1:0.1-10, preferably 1:0.5-2, more preferably 1:0.9-1.1, wherein the weight of the polysaccharide is the weight of dry polysaccharide added in preparation of the aqueous solution of gelatinized cationic polysaccharide; and the combined dry weight of depolymerized lignin and polysaccharide may be 1-10 wt-% based on the total weight of the resulting blend; followed by II) mixing the blend of depolymerized lignin and polysaccharide at a temperature of 40-100° C., preferably 90-95° C., for a sufficient period of time, e.g. until the blend has changed color from grey-white to brown.

The gelatinized polysaccharide may suitably be allowed to cool to room temperature before combining it with depolymerized lignin, whereby the concentration of polysaccharide in the aqueous solution of gelatinized cationic polysaccharide can be more easily adjusted to the desired value.

The method may further comprise a step III) of filtering off any particles of 0.5 mm or greater, optionally followed by the step IV) of allowing the blend from step II) and/or filtrate from step III) to settle for e.g. 1-24 hour. The filtration reduces the risk of production problems in the subsequent paper making. Such particles may have a dark color, and the removal thereof decreases the risk of stains in a subsequently produced paper product and thus results in a more attractive paper product.

Subsequent step V) comprises recovering the depolymerized lignin. This step may comprise treating the product to remove solid impurities such as particles and undesired inactive ballast, e.g. by filtration and/or centrifugation and recovering the depolymerized lignin. The liquid phase after removal of solid impurities is the sizing additive. In a preferred final step VI), the pH of the sizing additive is adjusted to pH 5-8.5, e.g. to about pH 7 before adding to the pulp suspension. Further, it is preferable to protect the sizing additive against UV radiation before adding to the pulp suspension.

The depolymerized lignin blended with a cationic polysaccharide can be used as a sizing additive in the production of hydrophobic paper.

According to the present invention, an aluminium salt is added to a lignocellulosic pulp suspension. Usually the aluminium salt is first added to the pulp, then the sizing additive is added. The amount of aluminum salt added corresponds to at least 0.01 kg Al/t dry pulp. In certain embodiments, the aluminum salt may be added in an amount corresponding to 0.01-5 kg Al/t dry pulp, in an amount corresponding to 0.02 to 2 kg Al/t dry pulp or in an amount corresponding to 0.05 to 1 kg Al/t dry pulp. The aluminum salt may be selected from an aluminum chloride salt such as poly-aluminum-chloride (PAC), an aluminum sulphate salt such as Alum or any combination thereof. For example, a PAC salt such as Fennofloc A91, having a content of pure Al calculated as 12 w-% may be added in an amount of e.g. 1-10 kg/t dry pulp corresponding to 0.12 to 1.2 kg pure Al/t dry pulp. Alternatively, an Alum salt such as WiAL having a content of pure Al calculated as 4 w-% may be added in an amount of e.g. 2-20 kg/t dry pulp corresponding to 0.08-0.8 kg Al/t dry pulp.

The lignocellulosic pulp suspension to which the sizing additive is added may be selected from any suitable type of pulp suspension, e.g. a kraft pulp suspension, a recycle fiber pulp suspension or a suspension comprising a mixture of kraft pulp and recycle fibers, e.g. recycle fibers in an amount of up to about 50%, about 60%, about 70% or about 80% (w/w) as well as a suspension of bleached pulp, a suspension of chemi-thermomechanical pulp (CTMP), a suspension of sulfite pulp, a suspension of mechanical pulp (MP), a suspension of semi chemical pulp or any combination thereof. In addition to the sizing agent and the aluminum salt, also a retention aid, e.g. cationic polyacrylamide can advantageously be added to the pulp suspension.

The pH of the pulp suspension may be adjusted to about 5-8.5, e.g. to 6.5-7.5. The conductivity of the pulp suspension may be adjusted to 0-8000 μS/cm, e.g. to 1000-6000 μS/cm. The temperature of the pulp suspension may be adjusted to about 25-60° C.

In preferred embodiments, the method of the invention does involve addition of a hydrophobization agent selected from an ASA, an AKD and/or a rosin in an amount of less than 0.5 kg/t dry pulp, or less than 0.4 kg/t dry pulp, or of less than 0.2 kg/t dry pulp, or of less than 0.1 kg/t dry pulp to the pulp suspension. More preferably, no hydrophobization agent selected from an ASA, AKD and/or a rosin is added to the pulp suspension.

The present invention also relates to a hydrophobic paper obtainable by the described method.

In certain embodiments, the hydrophobic paper of the present invention is characterized by:

(i) a Cobb 60 value of 50 $g/m^2$ or less, 45 $g/m^2$ or less, or 40 $g/m^2$ or less as determined according to ISO 535, (ii) a Cobb 1,800 value of 155 $g/m^2$ or less, 130 $g/m^2$ or less, 125 $g/m^2$ or less, or 120 $g/m^2$ or less as determined according to ISO 535, (iii) a Cobb 1,800-2d value of 150 $g/m^2$ or less, 140 $g/m^2$ or less or 130 $g/m^2$ or less, as determined according to ISO 535, and/or (iv) (iv) a Cobb 1,800-4d value of 160 $g/m^2$ or less, 150 $g/m^2$ or less, 140 $g/m^2$ or less or 120 $g/m^2$ or less as determined according to ISO 535.

In certain embodiments, the hydrophobic paper of the present invention is free from any substantial amount of hydrophobization agents selected from an ASA, an AKD and/or a rosin and any reaction product thereof.

The use of an sizing additive based on depolymerized lignin can substantially eliminate the use of other sizing additives such as ASA, AKD, etc., while reaching full sizing, wherein the resulting hydrophobic paper product retains improved UV stability. Thus, the sizing additive based on depolymerized lignin is suitable for use as the sole sizing additive, i.e. the sole organic sizing additive in the manufacture of hydrophobic paper.

The present invention is further outlined by the following examples.

EXAMPLES

1. Materials and Methods 1.1 Production of Depolymerized Lignin

The starting material was black liquor with a typical dry solid content of 42%, a total lignin content of 214 g/l and a residual alkali content of 13 g/l. The base-catalyzed depolymerization was carried out in a 300 ml Parr pressure reactor using 100 ml of black liquor at 230° C. for 60 minutes as described in PCT/SE2017/050250 the content of which is herein incorporated by reference.

Material:

100 g black liquor 100 ml of tap water added to depolymerized solution prior acidification Acidification media: mainly sulfuric acid (>95%) optionally in combination with $CO_2$ Solvent: ethyl acetate Solvent volume: 250-300 ml 1.2 Blending Depolymerized Lignin with Cationic Starch A blend of depolymerized lignin with cationic starch was produced in accordance with the schematic view shown in FIG. 1.

First, cationic starch was cooked in water at 1.1-1.4 w/w %. When the starch solution had cooled down the concentration was adjusted to 1.0 w/w %. Thereafter the depolymerized lignin was added in a weight ratio 1:1 starch to depolymerized lignin. The blend was heated and stirred for 10 minutes and then treated with ultrasonic waves for 10 minutes. This sequence was repeated and then the blend was run through a coarse screen to remove the biggest undissolved black particles of ≥0.5 mm.

The blend was left to sediment for a couple of hours. Finally the solution was filtered and/or decanted and ready to use.

1.3 Production of Hydrophobic Paper

Paper sheets for evaluation of hydrophobicity (Cobb) and other paper properties were made in a dynamic sheet former from a lignocellulosic pulp suspension kraft pulp or mixtures of kraft pulp and recycled pulp which was a mix of 50% long fibers and 50% short fibers.

The dynamic sheet former was run with standard settings for liner sheets:

Nozzle 2510

Speed 1300 rpm

Pressing 3 bar

Drying in SFTI-dryers

Sheet grammage 135 g/m$^2$

Chemical Dosage Sequence:

1. Starch/depolymerized lignin blend: different dosages from 2.5-10 kg depolymerized lignin/t of dry pulp were tested.
2. PAC (Fennofloc A91): different dosages from 1-5 kg/t of dry pulp were tested.
3. ASA (Fenno_Size 1100): different dosages from 0.1-0.4 kg/t of dry pulp were tested.
4. C-PAM (cationic acrylamide copolymer) retention aid, 0.2 kg/t of dry pulp were used for all sheets A representative list of recipes is shown using the additives ASA and PAC and depolymerized lignin with the respective dosages in Table 1. The reference recipe was 0.8 kg/t of dry pulp of ASA and 1.5 kg/t of dry pulp of PAC.

TABLE 1

List of different recipes of depolymerized lignin (Lo), PAC and ASA.

| Recipe No. | Lo | PAC | ASA |
|---|---|---|---|
| 1 | 10 | 1.5 | 0.4 |
| 2 | 5 | 1.5 | 0.4 |
| 3 | 2.5 | 1.5 | 0.4 |
| 4 | 5 | 1.5 | 0.2 |
| 5 | 2.5 | 1.5 | 0.2 |
| 6 | 10 | 1.5 | 0.1 |
| 7 | 5 | 1.5 | 0.1 |
| 8 | 2.5 | 1.5 | 0.1 |
| 9 | 10 | 1 | 0 |
| 10 | 10 | 1.5 | 0 |
| 11 | 10 | 3 | 0 |
| 12 | 5 | 1 | 0 |
| 13 | 5 | 1.5 | 0 |
| 14 | 5 | 3 | 0 |
| 15 | 2.5 | 3 | 0 |
| 16 | 5 | 3 | 0.1 |
| 17 | 5 | 5 | 0 |
| 18 | 2.5 | 5 | 0 |

1.3.1 Pulp Preparation

Refined (ready to use) unbleached kraft pulp with a fiber concentration of 3-5% was diluted to a pulp suspension with 0.5% w/w fiber concentration. The conductivity of the suspension was adjusted to 1000-1400 μS/cm, and pH was adjusted to 7.2-7.4. All trials were performed with pulp suspension and all additives kept at room temperature.

1.3.2 Sheet Making in the Dynamic Sheetformer™

1. Pulp suspension for one sheet, aiming for a specific sheet weight of 140 g/m$^2$, was added to the sheet former and stirring was started.
2. The sizing additive based on depolymerized lignin—if any—was added in amounts of 2.5-10 kg depolymerized lignin/t dry pulp. The mixture was stirred for 30 s.
3. PAC (Poly Aluminum Chloride)—if any—was added in amounts of 1-5 kg/t dry pulp. The PAC product was diluted to 1% before use. The mixture was stirred for 30 s.
4. The hydrophobization additive ASA—if any—was added in an amount of 0.1-0.8 kg/t dry pulp. The mixture was stirred for 30 s.
5. The retention aid, C-PAM (cationic polyacrylic amide), was added in an amount of 0.2 kg/t dry pulp. The product was diluted to 0.1% before use. The mixture was stirred for 30 s.
6. The pulp suspension was sprayed on the rotating wire.
7. When all pulp was sprayed onto the wire, dewatering was started.
8. The sheet was lifted out of the sheet former and pressed through a roll press at 3 bar.
9. The sheet was dried restrained in a heat dryer (trade name=STFI dryer).

1.4 Paper Characterization 1.4.1 Cobb Analysis

The purpose of the sizing additive is to reduce the water penetration into the paper. This water penetration is measured as Cobb value. The values $Cobb_{60}$, $Cobb_{1800}$ and $Cobb_{1800\text{-}2d}$ (after pretreatment of 2 days in an UV-light cabinet) were measured on all sheets. The values $Cobb_{1800-3d}$ and $Cobb_{1800-4d}$ (after 3 or 4 days pretreatment in an UV-light cabinet) were measured on selected samples. Measurements were performed according to ISO 535 except for the surface area where a smaller measuring area of 50 $cm^2$ instead of 100 $cm^2$ was used.

The method for UV-light pre-treatment is described below:

A color test cabinet supplied by Just-Normlicht GmbH was used. The light source used was D65 plus UV. The samples were placed on a shelf 10 cm below the light tubes. The sample temperature during light exposure was about 30° C. due to warmth from the light tubes. After the test pieces were exposed to light for the chosen time, they were conditioned in the paper testing lab (climate according to ISO 187:) for at least 2 h before testing. Duplicate sample testing is recommended.

For testing a Cobb apparatus was fitted with a 50 $cm^2$ cylinder instead of a 100 $cm^2$ cylinder. The sample size when using 50 $cm^2$ Cobb cylinder was 10×10 cm. This follows the ISO 535 standard except for the size of the cylinder and the samples.

It is, of course, possible to use a standard Cobb cylinder (100 $cm^2$) and standard samples size as well.

1.4.2 Paper Strength and Stiffness

The measurements were made both at standard testing climate (23° C./50% relative humidity) and as wet strength. For wet tensile strength and stiffness the test strips were soaked in water for one hour before testing. The testing was performed in accordance to ISO 1924-3.

The dry matter content was also measured on the soaked test strips directly after testing according to ISO 287.

1.4.3 Product Safety Evaluation

The papers treated with depolymerized lignin were analyzed with two different methodologies; iso-octane extraction and migration to modified polypropylene oxide (Tenax®). Extraction with iso-octane is used to simulate contact with fatty food while Tenax migration simulates dry food contact.

Migration Test

The procedure for total extraction with TENAX was performed according to the Swedish Standard SS-EN 14338 as follows:

Paper samples were prepared by cutting 1 $dm^2$ or circular diameter of 112 mm with a scalpel. The procedure was carried out in duplicate and 4 g of TENAX was placed evenly in a small Petri dish. The Petri dish was covered with the test specimen and system closed with a larger Petri dish. Average of area of 7 $cm^2$ represents 1.8 g of Tenax. The samples were placed on the oven of 40° C. for 10 days.

Extraction with acetone were performed and followed by GC-MS analysis of the extracted material.

Total Extraction with Iso-Octane

The procedure for total extraction with iso-octane was performed according to the Swedish Standard SS-EN 15519 as follows:

The paper sample was cut and extracted with iso-octane or 95% v/v aqueous ethanol. The conditions used for simulating contact with fatty foodstuffs in general are 2 h at 20° C. for simulating short time contact or 24 h at 20° C. for simulating long time contact. The samples were cut and taken into pieces of approximately 1 $cm^2$ to 2 $cm^2$. Samples were weighted (10±0.1 g of the test pieces) and put into conical flasks. After adding 200 ml of the solvent the flasks were left to stand under the selected conditions and shaken from time to time. After extraction, the extract, if necessary was filtered. The extract or the filtrate of the extract was used for analysis.

The extracts were analyzed with GC-MS after derivatization with trimethylsilane as described below. A semi-quantitative determination of the identified substances was made using di-ethylnaphthalene as internal standard.

1.4.4 Other Characterization Techniques

GC-MS Analysis

The product components were analyzed by GC-MS. The GS-MS instrument hardware and settings are shown below:

Instrument: ISQ Trace GC Ultra AS Triplus, Thermo Scientific

Column ZB-5MSi: 30 m, 0.25 mm id, 0.25 μm film thickness

Carrier: He, 1.0 ml/min constant flow

Injector temperature: 260° C.

Oven program: 40° C. 1 min hold time, ramp 1: 5°/min 40-250° C., ramp 2: 20°/min 250-300° C.

Transfer line 240° C.

Ion source 250° C.

The internal standard was 2,6-diethylnaphthalene.

The sample preparation method applied for depolymerized lignin was the following: 2 mg product was dissolved in 3 ml acetone (GC quality) and 1 ml of this solution was added to a vial. The solvent was evaporated and 50 ml internal standard was added and then evaporated again. The concentration of the internal standard was 1 mg/ml.

The sample was derivatized by adding 100 μl of N,O-bis (trimethylsilyl) trifluoroacetamide (BSTFA) and 100 μl of dry acetone to the vial. The closed vial was heated in an oven for 25 minutes at 70° C. In samples without derivatization 200 μl dry acetone were added.

FTIR-Analysis

Attenuated Total Reflectance-Fourier Transform Infrared (ATR-FTIR) spectra were recorded using Thermo Scientific Nicolet iS50 FT-IR spectrometer. Samples were measured in ATR mode directly after pressing the samples on the diamond crystal of the iS50 ATR module (45° incidence angle). For each measurement, 32 scans with a 4 $cm^{-1}$ resolution were acquired before Fourier transformation.

Analysis of Metal Content by ICP-OES

The metal content was determined by ICP-OES (Inductively coupled plasma-Optical Emission Spectroscopy) technology. The instrument used was an iCAP 6000 series from Thermo Scientific with an ASX-520 auto sampler. The sample preparation method was the following:

A 0.2 g dry sample of depolymerized lignin was added to a vial and water was added to a total volume of 10 ml. This vial was slowly loaded with 2 ml $H_2O_2$ and left to react for 10 minutes. After this reaction 1 ml concentrated $HNO_3$ was added. The sample was heated in a microwave oven (800 W) for 2 h to reach a temperature of 175° C. The pressure was 55 bar. The residence time at 175° C. was 20 minutes. After this procedure the sample was loaded into the ICP device.

2. Results 2.1 Cobb Values

Sheets of hydrophobic papers based on kraft fibers were made as described in detail in section 1 supra with different recipes as described in Table 1 supra. These sheets were tested for values for Cobb 60-0, Cobb 1800-0 and Cobb 1800-2d as described in Example 1.4.1. It was surprisingly found that ASA could be completely excluded from the recipes in the presence of depolymerized lignin and a 100% sizing agent substitution was achieved.

Figure 2:
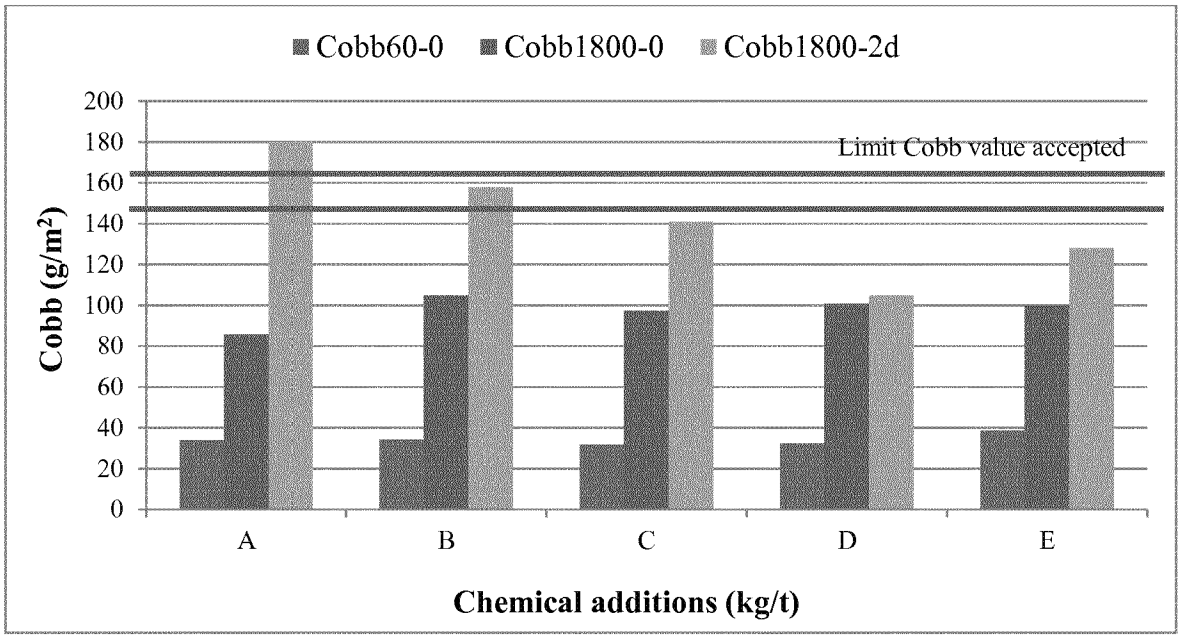
FIG. 2 shows Cobb60-0, Cobb1800-0 and Cobb1800-2d (columns are shown in this order for each sample) values of hydrophobic papers produced with different sizing additive recipes (amounts in kg/t dry pulp) for samples A (PAC 1.5, ASA 0.8), B (lignin oil 5, PAC 1.5, ASA 0.4), C (lignin oil 5, PAC 3), D (lignin oil 5, PAC 5) and E (lignin oil 2.5, PAC 5).

A summary of representative results samples is shown in FIG. 2. Whereas reference sample A (PAC 1.5 kg/t, ASA 0.8 kg/t), and sample B (lignin oil 5 kg/t; ASA 0.4 kg/t) did not reach the acceptable Cobb 1800-2d values indicating unsatisfactory sizing stability, the samples of the invention C (lignin oil 5 kg/t; PAC 3 kg/t), D (lignin oil 5 kg/t; PAC 5 kg/t) and E (lignin oil 2.5 kg/t; PAC 5 kg/t) did reach acceptable Cobb values under all test conditions. For recipes without ASA the target Cobb values (Cobb 60-0 value of 40 $g/m^2$ or less, Cobb 1800-0 value of 130 $g/m^2$ or less, or Cobb 1800-2d value of 150 $g/m^2$ or less) were achieved with good UV stability over time.

These results could be achieved with different types of depolymerized lignin. Further, by varying the depolymerized lignin and PAC quantities the final Cobb values could be tailored for specific products.

In addition, high UV stability was also achieved with sheets where 35% of virgin kraft fibers were replaced by recycled fibers (Table 2).

TABLE 2

Cobb development on recycled fibres at different dosages of additives.

| | Lo | PAC | ASA | $Cobb_{60-0}$ | $Cobb_{1800-0}$ | $Cobb_{1800-2d}$ |
|---|---|---|---|---|---|---|
| Mix recycled fibres | 0 | 1.5 | 0.8 | 220 | | |
| Mix recycled fibres | 5 | 1.5 | 0.4 | 112.4 | | |
| Mix recycled fibres | 5 | 3 | 0.1 | 84.8 | | |
| Mix recycled fibres | 5 | 5 | 0 | 37.8 | 117 | 112 |
| Mix recycled fibres | 2.5 | 5 | 0 | 38.4 | 114 | 141 |

2.2 Paper Strength and Stiffness

Figure 3:
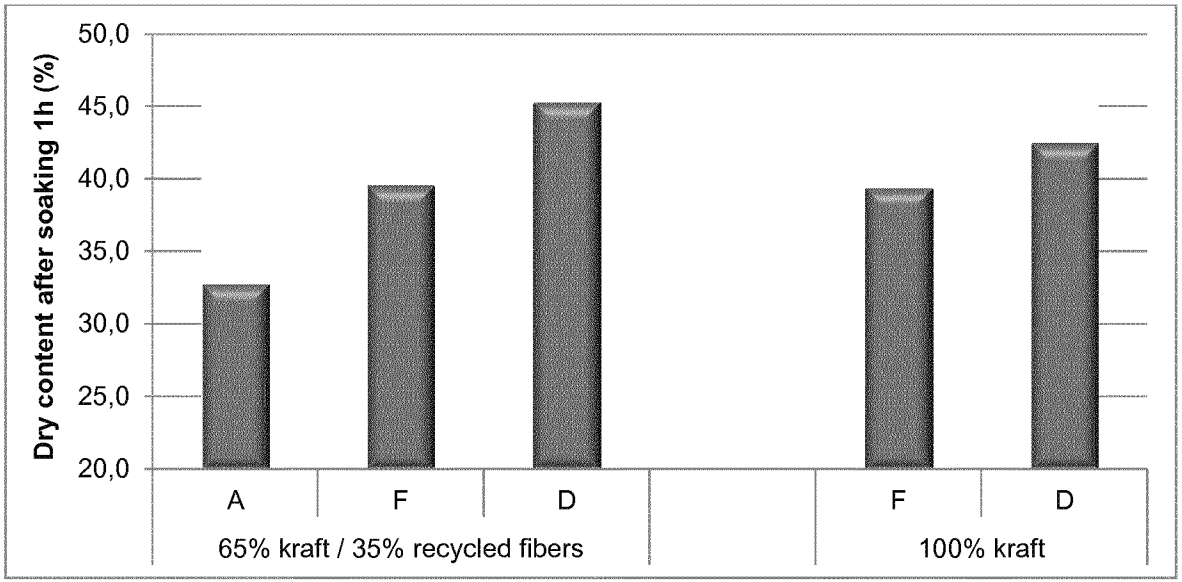
FIG. 3 shows the effect of the addition of lignin blends on the dry matter content of paper sheets with 35% recycled fibers and 65% virgin kraft fibers and paper sheets with 100% virgin kraft pulp produced with different sizing additive recipes (amounts in kg/t dry pulp) for samples A (PAC 1.5, ASA 0.8); F (lignin oil 5, PAC 1.5, ASA 0.4) and D (lignin oil 5, PAC 5).

Paper properties were measured on sheets from selected recipes of depolymerized lignin/PAC/ASA dosages. Addition of depolymerized lignin (lignin oil) in combination with an increased amount of PAC resulted in a slower water take-up in the sheets (FIG. 3). Sample A (PAC 1.5 kg/t; ASA 0.8 kg/t) had a substantially lower dry content than samples F (lignin oil 5 kg/t; PAC 1.5 kg/t; ASA 0.4 kg/t) and D (lignin oil 5 kg/t, PAC 5 kg/t).

Figure 4:
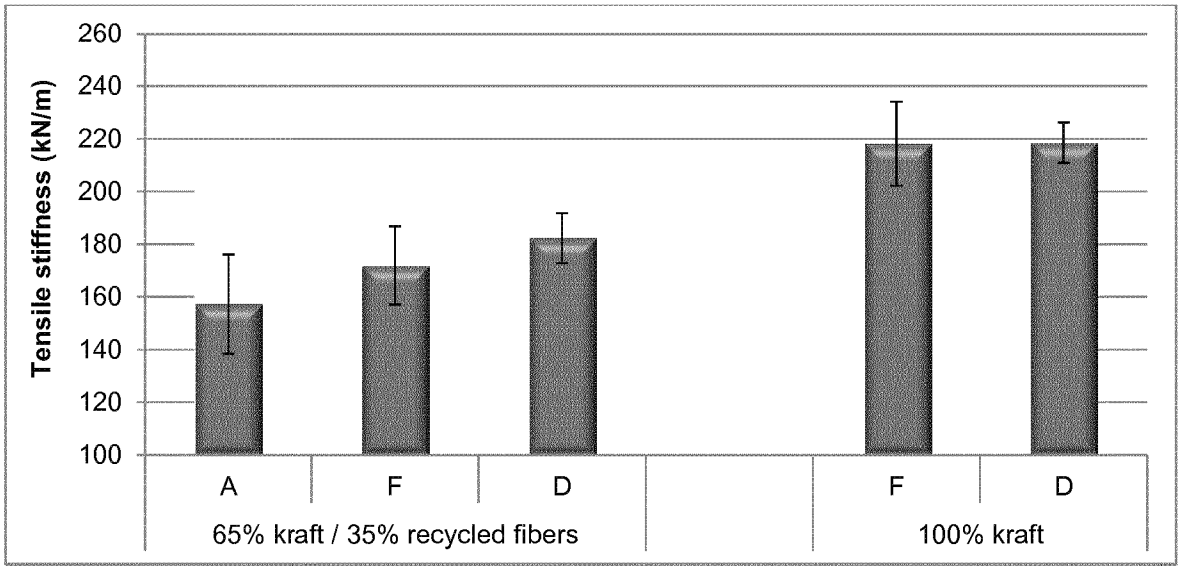
FIG. 4 shows the effect of the addition of lignin blends on tensile properties of paper sheets with 35% recycled fibers and 65% virgin kraft fibers and paper sheets with100% virgin kraft pulp produced with different sizing additive recipes (amounts in kg/t dry pulp) for samples A (PAC 1.5, ASA 0.8); F (lignin oil 5, PAC 1.5, ASA 0.4) and D (lignin oil 5, PAC 5).

That in turn resulted in higher tensile stiffness in the presence of depolymerized lignin after soaking the sheets 1 h, especially when recycled fibers were used (FIG. 4). Whereas sample A (PAC 1.5 kg/t; ASA 0.8 kg/t) did have the lowest tensile stiffness the addition of depolymerized lignin (lignin oil) resulted in a substantial improvement, c.f. samples F (lignin oil 5 kg/t; PAC 1.5 kg/t; ASA 0.4 kg/t) and D (lignin oil 5 kg/t; PAC 5 kg/t) both with mixtures of kraft and recycled fibers and with kraft fibers alone.

The tensile properties tested at standard testing climate (50% RH and 23° C.) were not affected by presence of lignin or PAC.

2.3 Long Term UV Light Exposure

Depolymerized lignin was found to work well at UV exposure and showed very good stability over time. No size reversion was observed for most of the recipes tested. In addition, PAC and depolymerized lignin blends have shown superior results regarding hydrophobation and stability. In order to fully evaluate the properties of depolymerized lignin as an organic UV absorber, test samples were exposed to long term UV light periods.

Figure 5:
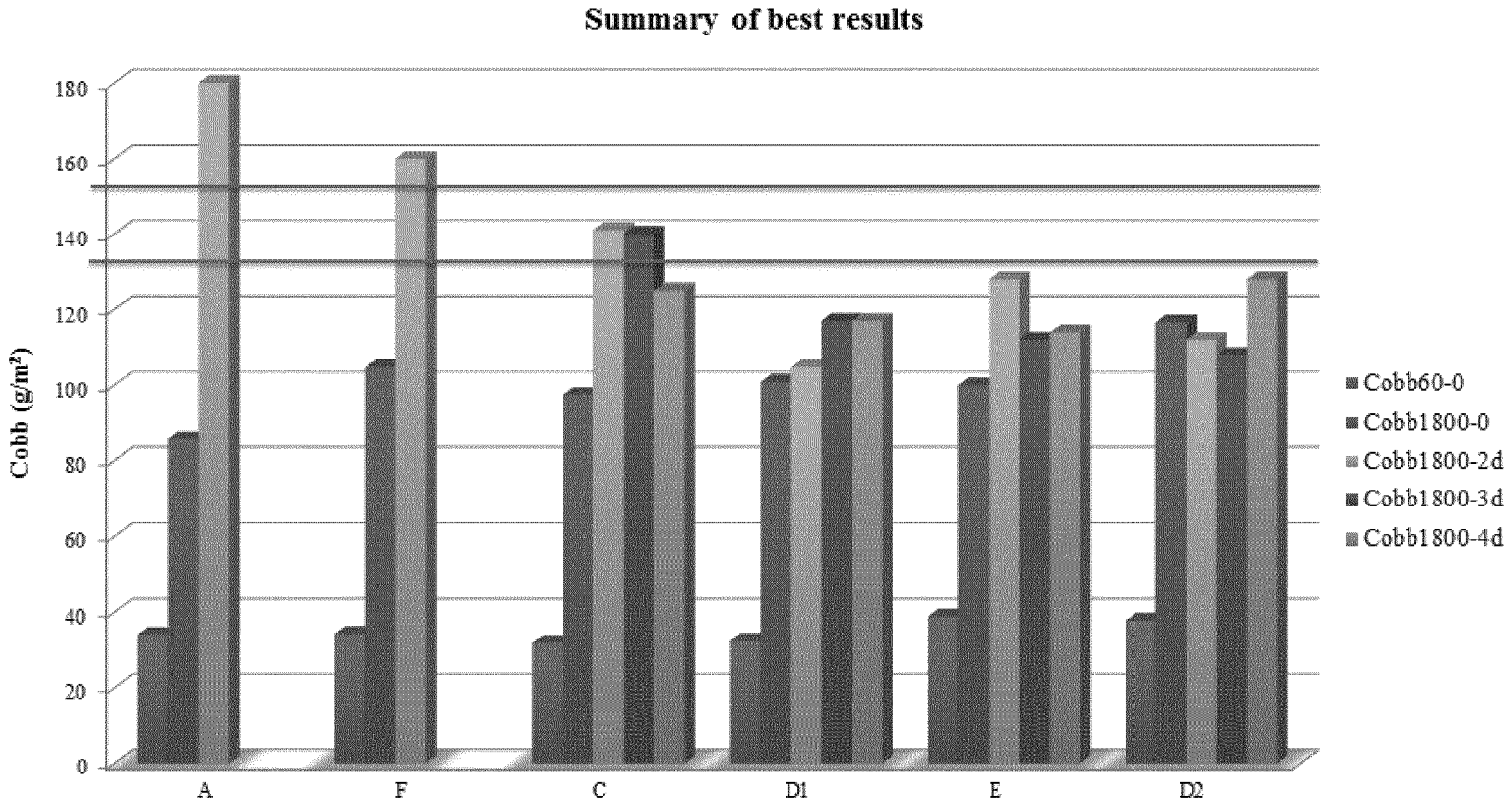
FIG. 5 shows the effect of long term UV light exposure on different paper sheets produced with different sizing additive recipes (amounts in kg/t dry pulp) for samples A (PAC 1.5, ASA 0.8), F (lignin oil 5, PAC 1.5, ASA 0.4), C (lignin oil 5, PAC 3), D1/D2 (lignin oil 5, PAC 5) and E (lignin oil 2.5, PAC 5). Recipes A, F, C, D1 and E were used on paper sheets with 100% virgin kraft pulp. Recipe D2 was used on paper sheets with 35% recycled fibers and 65% virgin kraft fibers. Columns for Cobb60-0, Cobb1800-0, Cobb1800-2d, Cobb-3d and Cobb1800-4d values are shown in this order. Cobb60-0, Cobb-1800-0 and Cobb1800-2d values are shown for all samples whereas Cobb1800-3d and Cobb-4d values are shown for inventive samples C. D1, D2 and E only.

FIG. 5 shows a summary of the Cobb 60-0, Cobb 1800-0, Cob 1800-2d, Cobb 1800-3d and Cobb 1800-3d and Cobb 1800-4d values. Sample A (PAC 1.5 kg/t; ASA 0.8 kg) represents a reference paper without lignin oil. Sample F (lignin oil 5 kg/t; PAC 1.5 kg/t; ASA 0.4 kg/t) contains both lignin oil and ASA. Samples C (lignin oil 5 kg/t; PAC 3 kg/t), D1/D2 (lignin oil 5 kg/t; PAC 5 kg/t) and E (lignin oil 2.5 kg/t; PAC 5 kg/t) were free from ASA.

From FIG. 5 it can be observed that hydrophobic properties were obtained and astonishing results regarding UV stability were achieved for samples C, D and E. Even more, the Cobb values for samples C, D and E were reduced or remained stable after 3-4 days of UV-light pre-treatment as described in section 1.4.1. In contrast, comparative samples A and F already show a size reversion after 2 days of UV-light pre-treatment and are thus of inferior quality compared to the samples of the invention.

2.4 Safety Analysis

The toxicity of depolymerized lignin was determined by the following two methods:

1. Migration with TENAX (simulates dry food)
2. Total extraction tests with iso-octane (simulates fat/liquid food)

The tests were performed on depolymerized lignin when applied into paper as described in section 1.4.3. The aim is to determine migration of phenolic and aromatic compounds from the paper. According to both methods no traces of free phenolic and aromatic compounds were detected after the sizing agent based on depolymerized lignin was applied. Traces of wood extractives, carboxylic acids and ketones were identified which were also found in the reference paper.

Table 3 summarizes the volatile compounds identified by GC-MS. Volatiles in depolymerized lignin are in ppb range and do not represent any safety risk.

TABLE 3

Identification of volatile compounds in depolymerized lignin.

| Identified compounds | mg/g | mg/ml | μg/g | μg/ml |
|---|---|---|---|---|
| 2,3-Dihydro-p-dioxine and 1,3-dioxol-2-one | 0.001480 | 0.001330 | 1.48 | 1.33 |
| 2-Pentanone | 0.000883 | 0.000792 | 0.883 | 0.792 |
| Trimethylsilanol acetate | 0.002400 | 0.002150 | 2.4 | 2.15 |
| Dimethyl disulfide | 0.027000 | 0.024200 | 27 | 24.2 |
| Toluene | 0.006580 | 0.005900 | 6.58 | 5.9 |
| Cyclo-pentanone | 0.000843 | 0.000756 | 0.843 | 0.756 |
| 4-Methyl-3-pentene-2-one | 0.001020 | 0.000918 | 1.02 | 0.918 |
| Siloxane | 0.001460 | 0.001310 | 1.46 | 1.31 |
| 4-Hydroxy-4-methyl-2-pentanone | 0.036900 | 0.033100 | 36.9 | 33.1 |
| Ethylbenzene | 0.000954 | 0.000856 | 0.954 | 0.856 |
| p-Dimethylbenzene (p-Xylene) | 0.002030 | 0.001820 | 2.03 | 1.82 |
| o-Dimethylbenzene (o-Xylene) | 0.000711 | 0.000638 | 0.711 | 0.638 |
| Methoxy benzene | 0.014500 | 0.013000 | 14.5 | 13 |
| Summary | 0.0968 | 0.0868 | 96.8 | 86.8 |

3. Conclusions

Depolymerized lignin is suitable as a sizing agent in the manufacture of hydrophobic paper with a $Cobb_{1800-0}$ value of <125 $g/m^2$.

100% replacement of ASA or other known hydrophobization agents is possible.

The addition of an aluminum salt, e.g. PAC in higher quantity to the system may be beneficial for the activity of depolymerized lignin towards hydrophobation.

The paper water resistance (Cobb values) showed UV stability over time and even after 4 days of exposure under controlled UV light (four days under UV corresponds to approximately 20 days in daylight).

Migration of free phenolic or aromatic compounds was not detectable.

The invention claimed is:

1. A method of producing hydrophobic paper comprising the step of adding (i) a sizing additive comprising a blend of a depolymerized lignin having an average molecular weight of 400-2500 g/mol with an auxiliary component selected from a cationic polysaccharide and/or gelatin, (ii) an aluminum salt, and (iii) optionally a retention aid, to a lignocellulosic pulp suspension at the wet end of a paper manufacturing process, wherein the depolymerized lignin is added in an amount of 0.5 to 20 kg/t dry pulp calculated as dry weight of depolymerized lignin, and the aluminum salt is added in an amount corresponding to at least 0.01 kg Al/t dry pulp.

2. The method of claim 1, wherein the depolymerized lignin of the sizing additive (i) is added in an amount of 1 to 15 kg/t dry pulp.

3. The method of claim 1, wherein the depolymerized. lignin of the sizing additive (i) is selected from depolymerized kraft lignin, depolymerized lignin precipitated from kraft black liquor, depolymerized lignositlfonate lignin, depolymerized hydrolysis lignin, depolymerized organosols lignin, depolymerized sulfur-free lignin and/or depolymerized lignin from lignin first biomass.

4. The method of claim 1, wherein the depolymerized lignin of the sizing additive (i) is selected from lignin depolymerized with base catalysis; acid catalysis; pyrolysis including fast pyrolysis;

hydrothermal liquefaction; subcritical or supercritical fluids such as water, acetone, ioxane, $CO_2$, methanol, ethanol or combinations thereof; or a catalyst under reducing conditions.

5. The method of claim 1, wherein the depolymerized lignin is characterized by an average weight molecular weight of 400-1500 g/mol.

6. The method of claim 1, wherein the depolymerized lignin is characterized by an average weight molecular weight of 400-1000 g/mol.

7. The method of claim 1, wherein the cationic polysaccharide is gelatinized cationic starch.

8. The method of claim 1, wherein the aluminum salt (ii) is added in an amount corresponding to 0.01 to 5 kg Al/t dry pulp.

9. The method of claim 1, wherein the aluminum salt is selected from an aluminum chloride salt, an aluminum sulphate salt, or any combination thereof.

10. The method of claim 1, wherein the lignocellulosic pulp suspension is selected from a kraft pulp suspension, a recycle fiber pulp suspension, a suspension comprising a mixture of kraft pulp and recycle fibers, a suspension of bleached pulp, a mechanical pulp suspension, a semi chemical pulp suspension, a sulfite pulp suspension, a chemic-thermomechanical pulp suspension, or any combination thereof.

11. The method of claim 1, wherein addition of a hydrophobization agent selected from an alkenyl succinic anhydride (ASA), an alkyl ketone dimer (AKD) and/or a rosin in an amount of less than 0.5 kg/t dry pulp to the pulp suspension is carried out.

12. The method of claim 1, wherein no addition of a hydrophobization agent selected from an alkenyl succinic anhydride (ASA), an alkyl ketone dimer (AKD) and/or a rosin to the pulp suspension is carried out.

13. A hydrophobic paper obtainable by the method of claim 1, comprising a depolymerized lignin characterized by an average molecular weight of 400-2500 g/mol.

14. The hydrophobic paper of claim 13, characterized by (i) a Cobb 60 value of 50 $g/m^2$ or less as determined according to ISO 535, (ii) a Cobb 1,800 value of 155 $g/m^2$ or less as determined according to ISO 535, (iii) a Cobb 1,800-2d value of 150 $g/m^2$ or less as determined according to ISO 535, and/or (iv) a Cobb 1,800-4d value of 160 $g/m^2$ or less as determined according to ISO 535.

15. The hydrophobic paper of claim 13, which is free from a hydrophobization agent selected from an ASA, an AKD and/or a rosin and any reaction product thereof.

16. A method comprising adding, during production of hydrophobic paper, a blend of a depolymerized lignin having an average molecular weight of 400-2500 g/mol with an auxiliary component selected from a cationic polysaccharide and/or gelatin as the sole sizing additive in the production of hydrophobic paper.

* * * * *